US005829218A

United States Patent [19]

Murray et al.

[11] Patent Number: 5,829,218

[45] Date of Patent: Nov. 3, 1998

[54] MIRRORED DOOR AND METHOD OF MAKING SAME

[75] Inventors: David T. Murray, Mississauga; Paul R. McNeil, Burlington; Darryl R. Burt, Brampton, all of Canada

[73] Assignee: Premdor, Inc., Canada

[21] Appl. No.: 786,620

[22] Filed: Jan. 21, 1997

[51] Int. Cl.[6] ..... E06B 5/00; A47G 1/00

[52] U.S. Cl. ..... 52/455; 52/745.15; 52/784.16; 52/785.1

[58] Field of Search ..... 52/455, 204.53, 52/313, 476, 479, 481.1, 483.1, 716.1, 717.01, 741.4, 745.15, 745.16, 764, 780, 784.1, 784.16, 785.1, 795.1; 312/227; 359/871

[56] References Cited

U.S. PATENT DOCUMENTS

| | | | |
|---|---|---|---|
| 2,778,766 | 1/1957 | Kloote et al. | 52/745.15 X |
| 4,550,540 | 11/1985 | Thorn | 52/313 X |
| 4,579,613 | 4/1986 | Belanger | 52/313 X |
| 4,702,054 | 10/1987 | Turner | 52/784.1 X |
| 4,716,705 | 1/1988 | Formanek et al. | 52/784.1 |
| 4,811,538 | 3/1989 | Lehnert et al. | 52/455 |
| 4,819,405 | 4/1989 | Jackson | 52/795.1 |
| 5,052,163 | 10/1991 | Czekala | 52/775 |
| 5,355,654 | 10/1994 | Stanley | 52/784.1 |
| 5,560,168 | 10/1996 | Gagne et al. | 52/745.15 X |
| 5,568,713 | 10/1996 | Gagne et al. | 52/785.1 |

OTHER PUBLICATIONS

Ledo, Inc., Classic Reflections, Jan. 1995, pp. 1–2 (Brochure).

*Primary Examiner*—Michael Safavi
*Assistant Examiner*—Kevin P. Wilkens
*Attorney, Agent, or Firm*—Joseph W. Berenato, III

[57] ABSTRACT

A mirrored door includes at least four interconnected members providing a frame. The frame has first and second oppositely disposed sides and an uninterrupted interior perimeter defining a cavity. A door skin is secured to one of the sides and closes the cavity. A mirror is positioned within the cavity and conforms to the perimeter. A molding element is disposed about the perimeter. The molding element bears upon the mirror and abuts the members. The molding section is mechanically secured to the members so that the mirror is thereby retained within the cavity.

40 Claims, 4 Drawing Sheets

MIRRORED DOOR AND METHOD OF MAKING SAME

FIELD OF THE INVENTION

The disclosed invention is a mirrored door, and a method for making the mirrored door. More particularly, the disclosed invention is a molded interior door in which a door skin is cut to produce an opening in which a safety backed mirror is mechanically secured.

BACKGROUND OF THE INVENTION

The door or doors to many closets, hotel rooms, bathrooms, and the like frequently have a mirror applied to a surface thereof. Many times the mirror is a "full length" mirror. The mirror may be adhesively secured to the door surface, or sometimes it is attached through clips, molding, and the like which are mechanically secured to the door. In any event, the mirror typically is added to the door after its manufacture, frequently at the place of use. Because the mirror is added to the door after the door has been manufactured and oftentimes already installed, then additional costs and installation problems entail.

A molded door is formed from wood composites, and frequently has a hollow core. The molded door has skins which have recessed portions, typically four or more, between which there are flat or flush portions, in order to provide an aesthetically pleasing appearance. Typically both major surfaces of the door are formed from the same general type of door skin. Because of the recessed and flat portions of the molded door, then fastening a full length mirror on the door skin may create problems, either because of insufficient surface for adhesive attachment, or an inability to align the mechanical fasteners with appropriate sections of the door skin. Moreover, particularly where the mirror is attached through clips, the mirror may vibrate because it is secured at a relatively few number of locations. The vibrations may permit the clips eventually to dislodge, with the result that the mirror may fall and break.

In addition, the mirror itself or molding securing the mirror extends beyond the flush surface of the door increasing the thickness of the molded door. The increased thickness has disadvantages, especially when used in pocket doors, where a mirrored door sliding adjacent a companion door could contact and damage the companion door. A further disadvantage is that the molding, which extends beyond the door skin, does not match the trimming of a companion door.

Homeowners, contractors, hotel keepers, and the like are continuously seeking opportunities to reduce costs. Adding a mirror to an already manufactured door not only raises costs because of the need to secure and attach the mirror, but further increases costs and delays by need to procure the mirror, breakage, and the like. Those skilled in the art recognize that there is a need for a relatively low cost interior mirrored door which avoids the problems of the prior art, and yet which is easily shipped and installed. The disclosed invention meets these and other needs in the art.

SUMMARY OF THE INVENTION

A mirrored door, according to the invention, comprises at least four interconnected members providing a frame. The frame has first and second oppositely disposed sides, and an uninterrupted interior perimeter defining a cavity. A door skin is secured to one of the sides, and closes the cavity along that side. A mirror is positioned within the cavity, and conforms to the perimeter. A molding element is disposed around the perimeter. The molding element bears upon the mirror and abuts the frame members. The molding element is mechanically secured to the associated frame member, so that the mirror is thereby retained within the cavity.

A mirrored door comprises at least four interconnected members providing a frame. At least four interconnected wood composite blocks are positioned within the frame in uninterrupted manner. The blocks define first and second sides for the frame, and an uninterrupted interior perimeter defining a cavity. A door skin is secured to and extends wholly over one of the sides for closing the cavity. A plurality of protective elements are mounted upon the skin and extend into the cavity. A support is positioned within the cavity and conforms to the perimeter, the support being juxtaposed to the protective elements. A mirror is positioned within the cavity and is juxtaposed to the support, and the mirror conforms to the perimeter. A molding element is disposed about the perimeter, and the molding element bears upon the mirror and abuts the blocks. The molding element is mechanically secured to the associated block so that the mirror is thereby retained within the cavity.

A method of making a mirrored door comprises a first step of providing a first door skin. At least four members are positioned on the skin for defining a frame. The frame has a first side secured to the skin, and provides an uninterrupted interior perimeter defining a cavity. A second door skin is provided. The second skin is secured to a second side of the frame. The second skin is cut about the perimeter, and the cut portion is removed for thereby providing an opening therethrough coextensive with the cavity. A support is positioned within the cavity, and the support is coextensive with the perimeter. A mirror is positioned within the cavity in overlying relation to the support, the mirror also being coextensive with the perimeter. The mirror is then mechanically secured about the perimeter.

These and other objects and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein.

DETAILED DESCRIPTION OF THE INVENTION

Figure 4:
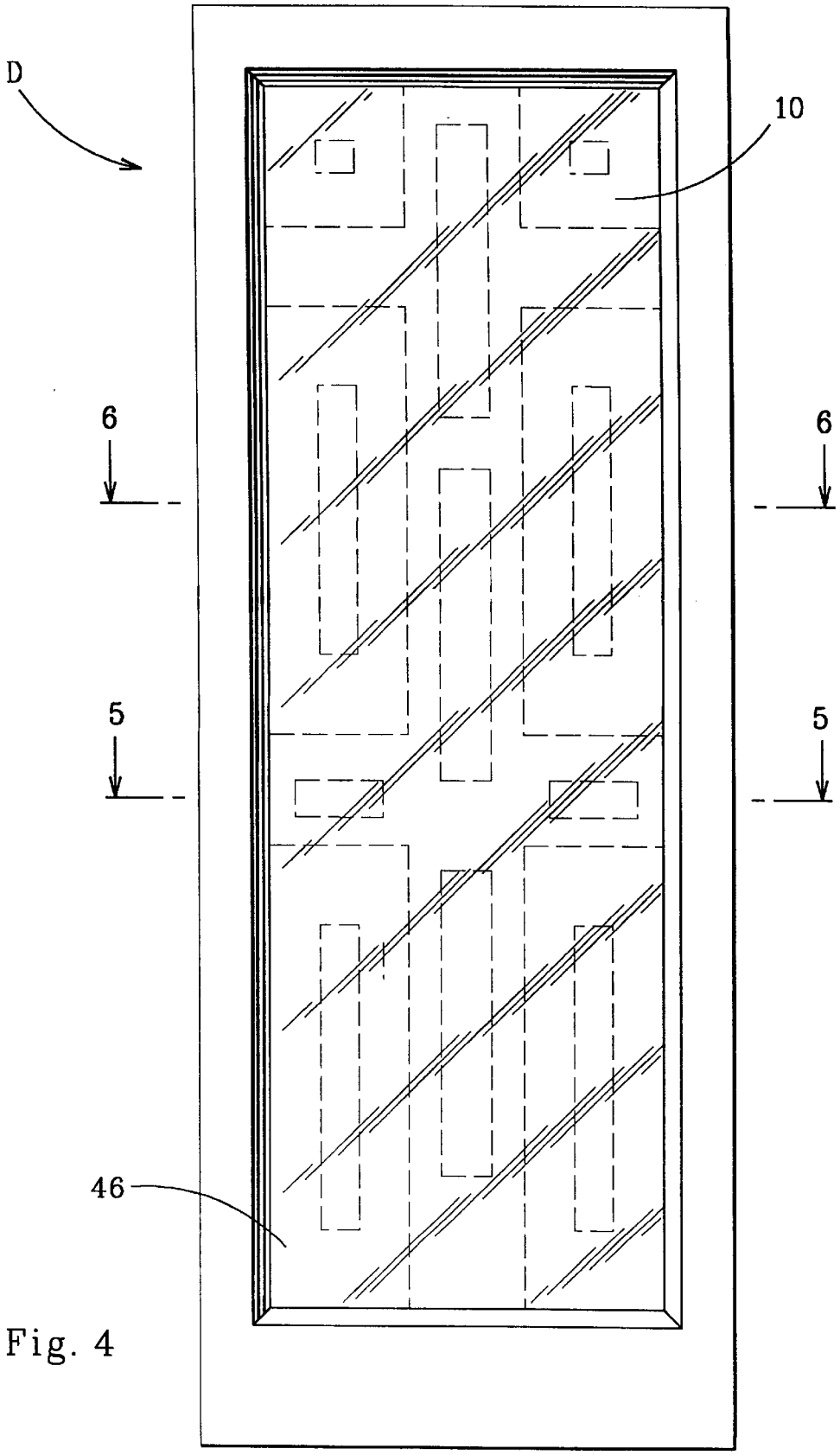
FIG. 4 is an elevational view of the mirrored door of the invention.

Door D, as best shown in FIG. 4, is a molded, hollow core door having a mirror 10 extending substantially over one surface thereof. Mirror 10 preferably is a safety backed mirror, such as provided by a mirrored glass substrate having a nylon web safety backing. While we prefer that the mirror 10 be a glass mirror, those skilled in the art recognize that other mirrored surfaces may be useful in practice of the invention. The mirror 10 preferably is a full length mirror.

Figure 1:
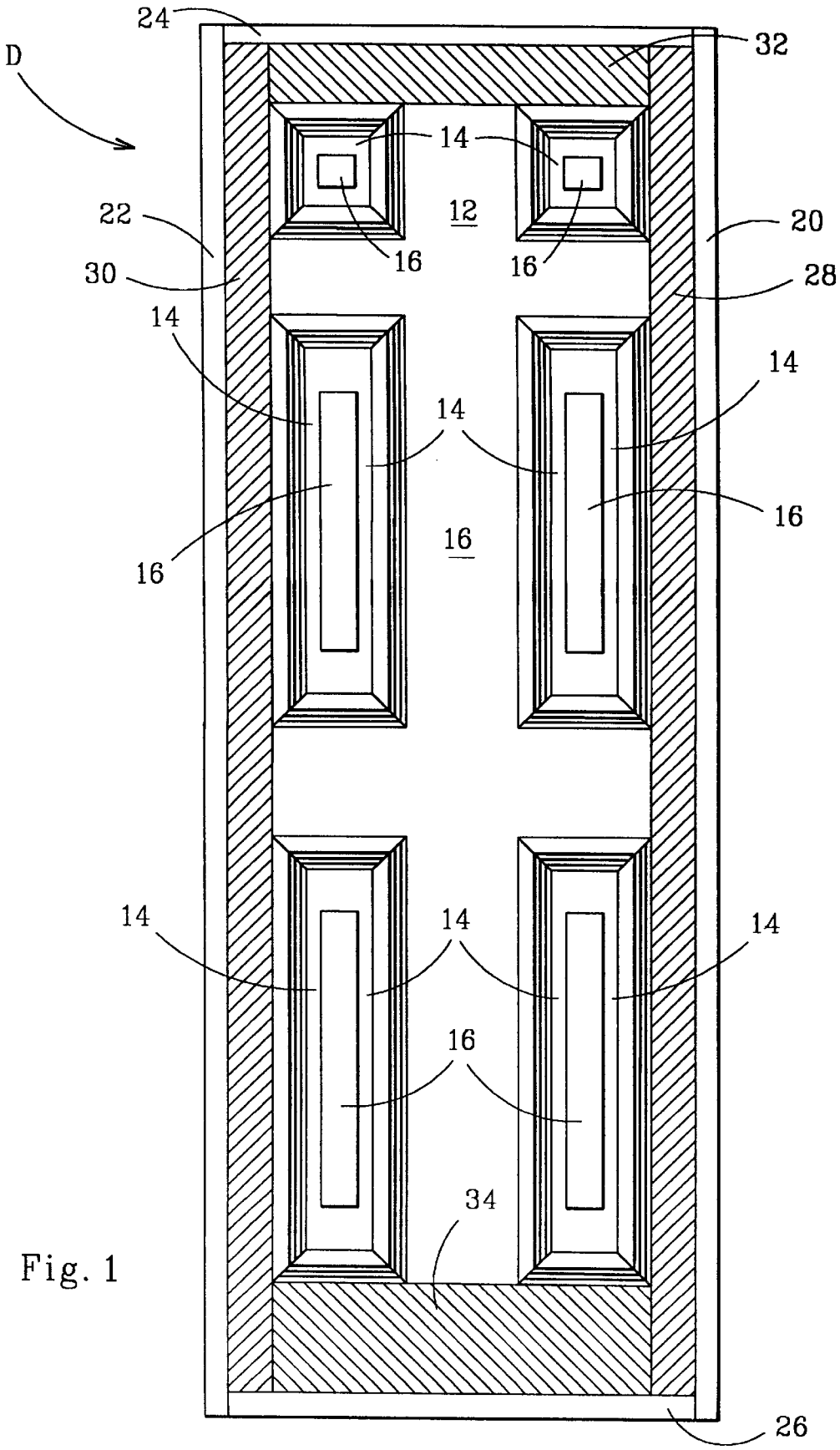
FIG. 1 is an elevational view, with portions broken away, of the door of the invention during its manufacture.
Figure 2:
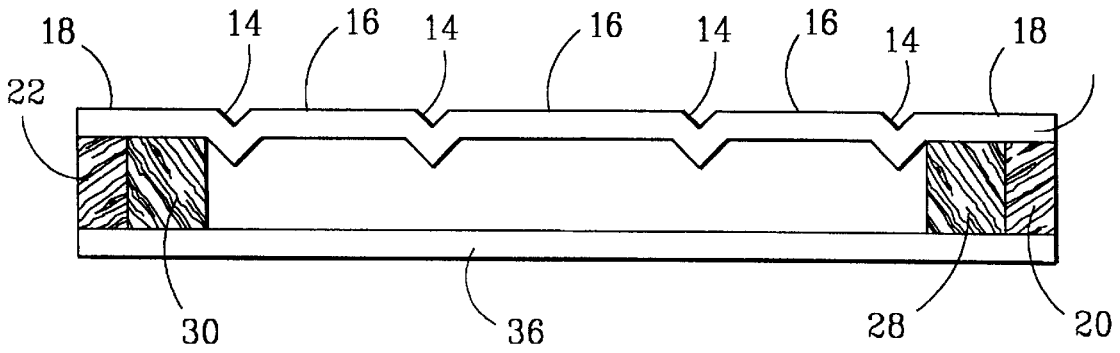
FIG. 2 is a cross-sectional view through the door of the invention.
Figure 5:
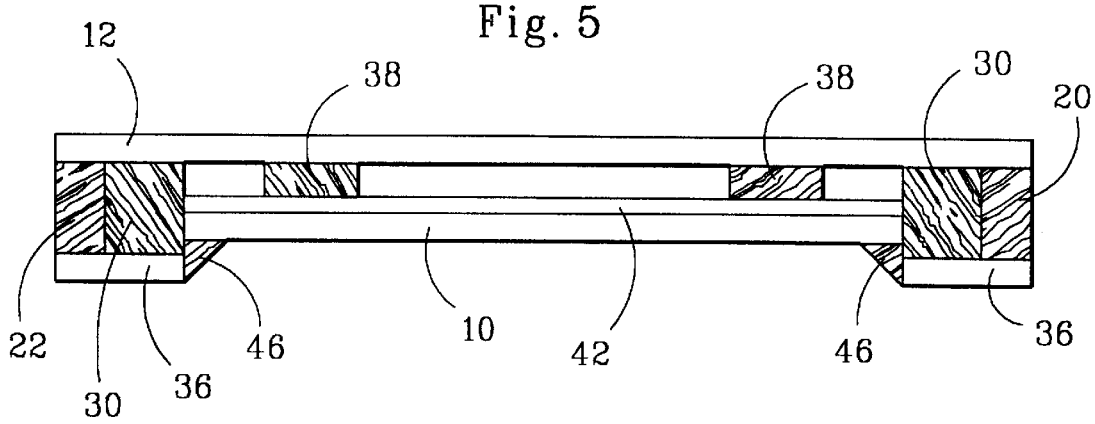
FIG. 5 is a cross-sectional view taken along the line 5—5 of FIG. 4 and viewed in the direction of the arrows.
Figure 6:
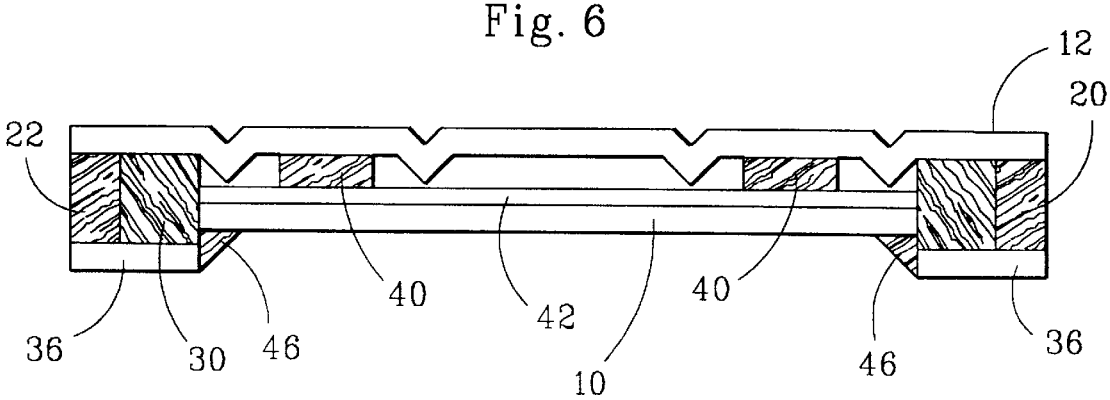
FIG. 6 is a cross-sectional view taken along the line 6—6 of FIG. 4 and viewed in the direction of the arrows.
Figure 3:
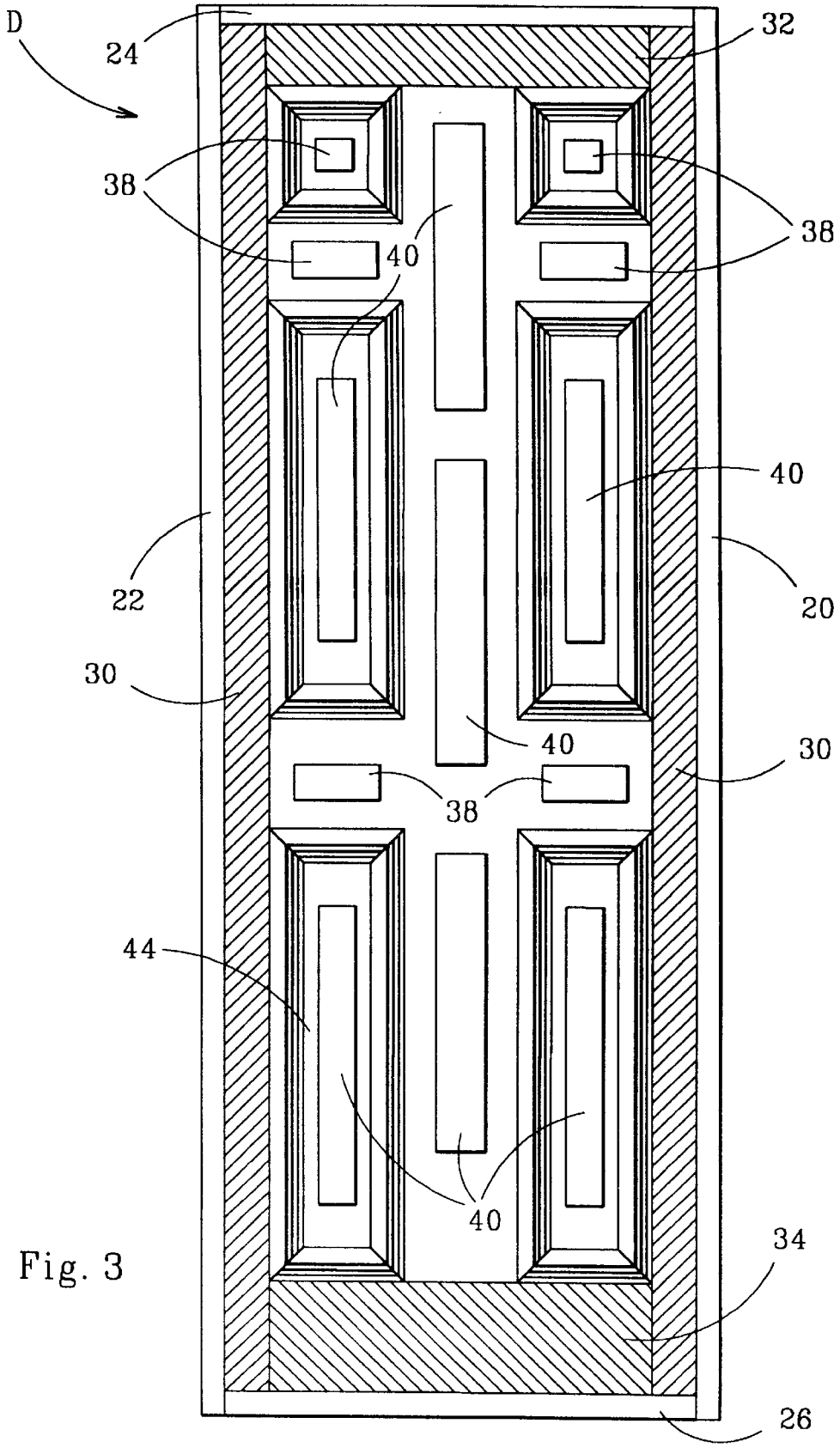
FIG. 3 is an elevational view, with portions broken away, of the mirrored door of the invention during its manufacture.

As noted, door D is a hollow core, molded door. In order to manufacture door D, we first secure a first door skin 12 and position same horizontally on an appropriate supporting surface. The door skin 12 is placed so that its outer or exterior surface faces outwardly. Those skilled in the art recognize that a molded door skin has flush sections and recess sections in order to provide an aesthetically pleasing sculpted appearance. Thus, as best shown in FIGS. 1 and 2, skin 12 has recess portion 14 between which flush portions 16 extend. Flaring portions 18 extend laterally outwardly. The flaring portions 18 and flush portion 16 all lie on a common plane. The flush and recess portions can be seen in FIG. 1, which illustrates the skin 12 along its inner surface. Those skilled in the art recognize that the skin 12 is typically a high density wood composite fiberboard which provides an exterior surface for door D. Although preferably a wood composite, the skin 12 may be a wood veneer, polymer, or other substrate.

Once skin 12 has been placed horizontally, then we position stiles 20 and 22 along its longitudinally extending lateral edges. Rails 24 and 26 are then positioned along the transverse or upper and lower edges, respectively, thereof The stiles 20 and 22 are adhesively secured to the rails 24 and 26, preferably through polyvinyl acetate ("PVA") glue. The stiles 20 and 22 and the interconnected rails 24 and 26 form a rectangular frame. We then position vertical particle board blocks 28 and 30 along the stiles 20 and 22. Particle board blocks 32 and 34 are positioned along rails 24 and 26. We prefer that the blocks be formed from particle board, because same provides sufficient strength and weight for door D. Particle board is also relatively inexpensive, thus serving to help minimize the cost of the door. Alternatively, the blocks may be made from laminated wood or lumber core. Other wood composites and wood products might be used to form the blocks 28–34. The blocks 28–34 are interconnected with PVA glue, which also preferably glues the blocks to the stiles and rails.

The blocks 28–34 define a frame having a first side which is closed by skin 12, and an opposite second side. The door skin 12 preferably is secured by PVA glue throughout the entirety of that surface which abuts the frame defined by the stiles and rails and the blocks. The blocks 28–34 define an open interior cavity which is bounded by an uninterrupted perimeter, with that cavity being closed by skin 12 which extends wholly over the first side of the frame.

A second door skin 36 is then placed over the frame, and is adhesively secured thereto throughout the entirety of its surface abutting the frame. The door skin 36 need not be a molded door skin, for reasons to be explained. Because the door skin 36 is not molded, then it has a lesser cost. Each of door skins 12 and 36 may have a wood grain simulating pattern on its exposed surface, in order to more realistically approximate the appearance of wood. Preferably each of skins 12 and 36 may be painted, stained, or otherwise colored as required by the end user.

Once the door skin 36 has been applied to the frame, then the door is placed in a press for approximately 20–30 minutes at approximately 40 pounds per square inch. The door is then staged at room temperature and humidity for two to three hours, thus allowing sufficient time for the PVA glue to harden and the moisture in the components to equilibrate.

After the door has been staged, then it is again positioned horizontally, with the skin 12 disposed downwardly. A router, having a one-half router bit, then cuts an opening in the skin 36 about the interior perimeter defined by the blocks 28–34. The thus resulting opening exposes the cavity defined by the frame, as best shown in FIG. 1. The cut out portion 42 of the skin 36 is then removed, for further use as explained. Because cut out portion 42 is subsequently used to manufacture door D, then costs are further reduced.

Once the cut out portion 42 of the skin 36 is removed, then we apply protective elements 38 and 40 to the inner surface of the door skin 12. The protective elements 38 and 40 are disposed in three parallel rows, with the protective elements 38 and 40 adhesively secured to the flush portions 16. Each of the protective elements 38 and 40 preferably is a styrofoam pad, of approximately one-half inch thickness. The styrofoam pads 38 and 40 are secured to the skin 12 with a silicone glue or other adhesive. The pads 38 and 40 each have a forward surface disposed within the cavity, with the surfaces lying on a common plane.

The cut out portion 42 of the door skin 12 is then positioned within the cavity in overlying juxtaposition to the pads 38 and 40. The cut out portion 42 provides a support. The cut out portion 42 may also be adhesively secured to the pads 38 and 40, if desired.

Safety backed glass mirror 10 is then positioned within the cavity in overlying relation to the support provided by cut portion 42. The mirror 10 and cut out portion 42 preferably conform to the inner perimeter of the frame defined by the blocks 28–34. Thus, the mirror 10 is a full length mirror, spanning substantially the entirety of the surface of the door D. The mirror 10 and cut out portion 42 are coextensive with the interior perimeter defined by blocks 28–34. Because the mirror D is in overlying juxtaposition to cut out 42, then the cut out 42 provides a support for mirror 10. In addition, because cut out portion 42 conforms to and is coextensive with the perimeter, then the door D has improved rigidity and resists distortion.

Once the mirror 10 has been positioned within the cavity, then a bead 44 of silicone caulk is applied to the edge of the mirror 10, in contact with the interior perimeter defined by the blocks 28–34. The silicone caulk provides a protective sealant, substantially reducing the ability of moisture to enter the cavity. Wood products, as those skilled in the art recognize, typically are manufactured at a specified moisture content, so the silicone bead 44, by eliminating moisture ingress, reduces the possibility of unwanted swelling of the components of the door D. Considering that the door D may, for example, be installed in a bathroom, which is an area of a home exposed to high humidity at times, then the caulk bead 44 increases the stability of the door D.

Molding element 46 is then placed about the interior perimeter defined by the blocks 28–34 in engagement with mirror 10. Preferably, molding element 46 is made of either wood or plastic. However, any suitable molding material may be used. When wood is used, molding element 46 includes four wood pieces secured about the interior perimeter defined by blocks 28–34 in engagement with mirror 10. The wood molding used may be of the same appearance as the molding used on the trimming of similar molded doors. Thus, the mirrored door as herein described will match a companion door of the same general appearance, resulting in a more aesthetically pleasing appearance.

Molding element 46 is mechanically secured to the blocks, preferably by one and one quarter (1¼) brad nails which are countersunk, approximately six to eight inches apart. We prefer that molding element 46 be mechanically secured to the blocks in order to provide a more reliable and effective connection resisting moisture, water, and the like. While we prefer brad nails, staple, screws, pins, adhesive materials and the like may be used.

Alternatively, molding element 46 may be a continuous plastic insert. The plastic insert may be snapped in, adhesively secured, or attached in any other appropriate fashion. The plastic may be relatively soft, so that the plastic insert will conform to the unfinished opening in skin 36 and the interior perimeter. The unfinished portion may be primed before molding element 46 is attached. A plastic insert may avoid a need to prime the unfinished portions.

In either alternative, molding element 46 does not extend beyond the outer surface of door skin 36. Because molding element 46 is wholly within the door thickness, then the thickness of the door may be minimized. The invention is advantageous when used in pocket doors, which necessarily should have no more than a specified thickness in view of their complementary nature.

While this invention has been described as having a preferred design, it is understood that it is capable of further modifications, uses, and/or adaptations, following the general principle of the invention, and including such departures from the present disclosure as have come within known or customary practice in the art to which the invention pertains, and as may be applied to the essential features hereinbefore set forth, and fall within the scope of the invention of the limits of the appended claims.

What we claim:

1. A mirrored door, comprising:

a) at least four interconnected members defining a frame, said frame having first and second oppositely disposed sides and an uninterrupted interior perimeter defining a cavity;

b) a first door skin secured to one of said sides enclosing said cavity, and a second door skin having an opening which conforms to said perimeter secured to said frame along said second side;

c) a mirror positioned within said cavity and conforming to said perimeter;

d) a molding element disposed about said perimeter, said molding element bearing upon said mirror and abutting said interconnected members about said perimeter; and e) attachment means securing said molding element to said interconnected members about said perimeter so that said mirror is thereby retained within said cavity.

2. The door of claim 1, wherein:

a) said molding element does not extend outwardly beyond said second skin.

3. The door of claim 2, wherein:

a) each of said frame members is a wood composite; and b) said members are adhesively secured together.

4. The door of claim 2, wherein:

a) said molding element is formed from the group consisting of plastic and wood.

5. The door of claim 2, wherein:

a) said molding element includes at least four molding sections, each of said four molding sections bearing upon said mirror and abutting one of said members; and b) said attachment means secures each of said sections to an associated member so that said mirror is thereby retained within said cavity.

6. The door of claim 2, wherein:

a) a plurality of protective elements are disposed upon said first skin and extend into said cavity; and b) said mirror overlies said protective elements.

7. The door of claim 6, wherein:

a) a support is disposed between said protective elements and said mirror, said support positioned within said cavity and conforming to said perimeter.

8. The door of claim 6, wherein:

a) said first skin is a molded door skin having a plurality of recessed sections; and b) some of said protective elements are positioned between said recessed sections.

9. The door of claim 6, wherein:

a) said first skin is a molded door skin having a plurality of recessed sections and a plurality of planar sections; and b) some of said protective elements are disposed on said recessed sections and some of said protective elements overlie said planar sections.

10. The door of claim 9, wherein:

a) each of said protective elements has a planar surface disposed within said cavity, and said surfaces lie on a common plane.

11. The mirror of claim 6, wherein:

a) each of said protective elements is a foam pad.

12. The mirror of claim 11, wherein:

a) an adhesive secures each of said pads to said first skin.

13. The door of claim 11, wherein:

a) a support is positioned within said cavity and conforms to said perimeter, said support disposed between said pads and engaged with said mirror.

14. The door of claim 13, wherein:

a) said first skin and said support each formed from a wood composite.

15. The door of claim 14, wherein:

a) a sealant is disposed about said mirror along said perimeter.

16. The door of claim 15, wherein:

a) said sealant is a silicone material.

17. A mirrored door, comprising:

a) at least four interconnected members providing a frame;

b) at least four interconnected wood composite blocks positioned within said frame in uninterrupted manner and thereby providing first and second sides and an uninterrupted interior perimeter defining a cavity;

c) a door skin secured to and extending wholly over one of said sides for closing said cavity;

d) a plurality of protective elements mounted upon said skin and extending into said cavity;

e) a support positioned within said cavity and conforming to said perimeter, said support juxtaposed to said elements;

f) a mirror positioned within said cavity and juxtaposed to said support, said mirror conforming to said perimeter;

g) a molding element disposed about said perimeter, said molding element bearing upon said mirror and abutting said interconnected blocks about said perimeter; and h) means for securing said molding element to said interconnected blocks about said perimeter so that said mirror is thereby retained within said cavity.

18. The door of claim 17, wherein:

a) said molding element is formed from the group consisting of plastic and wood.

19. The door of claim 17, wherein:

a) said molding element is at least four molding sections, each of said at least four molding sections bearing upon said mirror and abutting one of said blocks; and b) means for securing each of said sections to an associated block so that said mirror is thereby retained within said cavity.

20. The door of claim 17, wherein:

a) a sealant is disposed about said mirror and said blocks for providing a moisture barrier.

21. The door of claim 20, wherein:

a) said sealant is a silicone composition.

22. The door of claim 17, wherein:

a) each of said blocks is formed from a member selected from the group consisting of particle board and lumber core.

23. The door of claim 22, wherein:

a) said members and said blocks are adhesively secured; and b) said skin is adhesively secured to said one side.

24. The door of claim 17, wherein:

a) said means for securing includes a plurality of mechanical fasteners.

25. The door of claim 24, wherein:

a) each of said protective elements is a foam pad.

26. The door of claim 25, wherein:

a) each of said pads is adhesively secured to said skin.

27. The door of claim 26, wherein:

a) said pads are disposed in three parallel rows, each row having a plurality of pads and the pads in each row being spaced apart.

28. The door of claim 27, wherein:

a) some of said pads of each row extend in a first direction, and the remaining pads of each row extend in a transverse section direction.

29. The door of claim 25, wherein:

a) each of said pads has a bearing surface engaged with said support, and said surfaces lie on a common plane.

30. The door of claim 29, wherein:

a) said door skin and said support are each formed from a wood composite.

31. The door of claim 29, wherein:

a) said door skin is a molded skin having a plurality of recessed sections and a plurality of flush sections; and b) some of said pads are mounted to said recessed sections and some of said pads are mounted to said flush sections.

32. A method of making a mirrored door comprising the steps of:

a) providing a first door skin;

b) positioning on the skin at least four members defining a frame, the frame having a first side secured to the skin and an uninterrupted interior perimeter defining a cavity;

c) providing a second door skin, the second skin secured to a second side of the frame;

d) cutting the second skin about the perimeter and removing the cut portion for thereby providing an opening coextensive with the cavity;

e) positioning within the cavity a support, the support being coextensive with the perimeter;

f) positioning within the cavity in overlying relation to the support a mirror, the mirror being coextensive with the perimeter; and g) mechanically securing the mirror about the perimeter.

33. The method of claim 32, including the step of:

a) utilizing the cut portion of the second skin as the support.

34. The method of claim 32, including the step of:

a) interposing a plurality of protective elements between the first skin and the support.

35. The method of claim 34, including the step of:

a) adhesively securing the protective elements to the first skin.

36. The method of claim 34, including the step of:

a) providing foam pads as the protective elements.

37. The method of claim 34, including the step of:

a) mechanically securing the mirror through a plurality of molding sections overlying the mirror and secured to the frame about the perimeter.

38. The method of claim 37, including the step of:

a) mechanically securing the molding sections to the frame.

39. The method of claim 37, including the step of:

a) applying a protective sealant about the mirror and the perimeter.

40. The method of claim 37, including the step of:

a) providing a silicone composition as the protective element.

* * * * *

UNITED STATES PATENT AND TRADEMARK OFFICE

CERTIFICATE OF CORRECTION

PATENT NO. : 5,829,218

DATED : November 3, 1998

INVENTOR(S) : David T. Murray, Paul R. McNeil, and Darryl R. Burt

It is certified that error appears in the above-indentified patent and that said Letters Patent is hereby corrected as shown below:

On the Title page, item [56] References Cited the following should be added: --FOREIGN PATENT DOCUMENTS

| | | |
|---|---|---|
| 2825914 | 12/1978 | Germany |
| 2442330 | 11/1978 | France |
| 2637531 | 4/1990 | France-- |

Signed and Sealed this

Twenty-ninth Day of August, 2000

*Attest:*

*Attesting Officer*

Q. TODD DICKINSON

*Director of Patents and Trademarks*